US007750263B2

(12) United States Patent
Godesa

(10) Patent No.: US 7,750,263 B2
(45) Date of Patent: Jul. 6, 2010

(54) ARRESTING DEVICE FOR A DRIVE TRAIN

(75) Inventor: Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 445 days.

(21) Appl. No.: 11/905,900

(22) Filed: Oct. 5, 2007

(65) Prior Publication Data

US 2008/0083600 A1 Apr. 10, 2008

(30) Foreign Application Priority Data

Oct. 6, 2006 (DE) ..... 10 2006 048 124

(51) Int. Cl.
*H01H 5/00* (2006.01)

(52) U.S. Cl. ..... 200/400

(58) Field of Classification Search ..... 200/400, 200/401, 500, 501, 244; 218/7, 17, 20, 21, 218/30–32, 140, 153, 154; 335/6, 16
See application file for complete search history.

(56) References Cited

U.S. PATENT DOCUMENTS

| | | | | |
|---|---|---|---|---|
| 5,082,996 | A * | 1/1992 | Takahashi et al. | 200/401 |
| 6,448,522 | B1 * | 9/2002 | Rosen et al. | 200/400 |
| 6,689,979 | B1 * | 2/2004 | Bach et al. | 218/40 |
| 6,777,636 | B2 * | 8/2004 | Ahlert et al. | 200/401 |
| 6,831,240 | B2 * | 12/2004 | Bach et al. | 200/400 |
| 7,038,155 | B2 * | 5/2006 | Ahlert et al. | 200/400 |
| 7,268,652 | B2 * | 9/2007 | Marks et al. | 335/6 |
| 7,368,677 | B2 * | 5/2008 | Jones et al. | 200/400 |
| 7,397,008 | B2 * | 7/2008 | Ahn et al. | 200/400 |
| 7,449,652 | B2 * | 11/2008 | Rakus et al. | 200/400 |
| 7,449,653 | B2 * | 11/2008 | Gibson et al. | 200/400 |
| 7,459,650 | B2 * | 12/2008 | Weister et al. | 200/400 |

(Continued)

FOREIGN PATENT DOCUMENTS

DE 1137614 B 10/1962

(Continued)

OTHER PUBLICATIONS

European Office Action, Jan. 29, 2009.

*Primary Examiner*—Michael A Friedhofer
(74) *Attorney, Agent, or Firm*—Harness, Dickey & Pierce, P.L.C.

(57) ABSTRACT

An arresting device is disclosed for a drive train which, in order to close a movable contact of an electric switch, can be moved from an OFF position into an ON position. In at least one embodiment, the arresting device includes an arresting including a pivot axis which extends outside its pivoting point. When the drive train is in its OFF position, the arresting element pivots from a position of rest into an arresting the position owing to a force which acts on its pivoting point, in the closing direction of the drive train, and in its arresting position, the arresting element is operatively connected to the drive train and blocks the movement of the drive train into it ON position. In at least one embodiment, the arresting device is suitable for use on transportation device, in particular on ships, and there is provision that in its position of rest, the arresting element is under the force effect of a restoring spring, and does not pivot into its arresting position until a defined acceleration of the electric switch is acting in the closing direction of the drive train.

19 Claims, 5 Drawing Sheets

U.S. PATENT DOCUMENTS

| | | | | |
|---|---|---|---|---|
| 7,598,467 | B2 * | 10/2009 | Gibson et al. | 200/400 |
| 2002/0053963 | A1 | 5/2002 | Dahl et al. | |

FOREIGN PATENT DOCUMENTS

| | | | |
|---|---|---|---|
| DE | 1216966 | B | 5/1966 |
| DE | 1276171 | | 8/1968 |
| DE | 3642383 | A1 | 6/1988 |
| DE | 19739702 | C1 | 12/1998 |
| GB | 263217 | A | 1/1927 |

* cited by examiner

ARRESTING DEVICE FOR A DRIVE TRAIN

PRIORITY STATEMENT

The present application hereby claims priority under 35 U.S.C. §119 on German patent application number DE 10 2006 048 124.0 filed Oct. 6, 2006, the entire contents of which is hereby incorporated herein by reference.

FIELD

Embodiments of the invention are generally in the field of electric switches and generally relate to an arresting device for a drive train. For example, they may relate to one where, in order to close, a movable contact of an electric switch can be moved from an OFF position into an ON position, having an arresting element; and/or where the arresting element has a pivot axis which extends outside its pivoting point, in which, when the drive train is in its OFF position, the arresting element pivots from a position of rest into an arresting position owing to a force which acts on its pivoting point, in the closing direction of the drive train; and/or one where, in its arresting position, the arresting element is operatively connected to the drive train and blocks the movement of the drive train into it ON position.

BACKGROUND

An arresting device for a drive train of an electric switch is known, for example, from the publication GB 263 217. In this known arresting device, the arresting element is a pendulum-like lever whose pivot axis is formed by the drive shaft of the drive train. A working face which is formed by an elongated hole of the lever enters into an operative connection with a counterpart of the drive train which is embodied as a pin, in which case the pin projects transversely from a supporting arm, arranged fixedly on the drive shaft, for a movable contact. At the same time, the position of rest of the arresting element is defined here by the gravitational force acting at the pivoting point. As soon as a force acts in the closing direction of the drive train, in particular as a result of tilting of the switch onto the drive train and the arresting element, the arresting element pivots into an arresting position about its pivot axis and thus prevents the contacts from closing when the switch tilts.

When electric switches are used on transportation devices, in particular on ships, they are subject to high mechanical stresses. In this context, the duration of the effect of shocks and vibrations, their frequency and amplitude and also the sensitivity of the electric switches themselves determine the results. When the switches are used on ships, a continuous loading of, for example, 15g (g=gravitational acceleration=9.81 m/s$^2$) with a duration of shock of, for example, 5 to 10 ms is predefined as a guideline value for manufacturers.

The arresting device which is known from document GB 263 217 is not provided for use under such high mechanical stresses since the arresting element which is embodied as a pendulum-like lever would bounce to and fro here between its position of rest and its arresting position. There would then be the risk of the contacts of the electric switch being released when the arresting element bounces back from its arresting position in the direction of its closing position.

SUMMARY

In at least one embodiment, the invention specifies an arresting device which is suitable for use on transportation devices, in particular on ships.

In at least one embodiment, in its position of rest, the arresting element of the arresting device is under the force effect of a restoring spring and does not pivot into its arresting position until a predefined acceleration of the electric switch is acting in the closing direction of the drive train.

In an example embodiment, the restoring spring is dimensioned in such a way that the arresting element only pivots into its arresting position starting from 15 times the gravitational acceleration of the switch.

In order to use just one arresting device to block a plurality of movable contacts which are driven by a common drive shaft by way of separate coupling rods, there is advantageously provision that in its arresting position the arresting element is operatively connected to the working face which is formed in a locationally fixed fashion on a drive shaft of the drive train. Here, this working face can be formed, for example, on a cam-like drive shaft segment.

In order to prevent wear to the working face of the arresting element and thus to ensure the effectiveness of the arresting element over the service life of the switch, a stop which is assigned to the arresting element and against which the arresting element abuts briefly before it reaches its arresting position is provided in at least one embodiment. This stop can be formed, for example, by a stop face of the cam-like drive shaft segment.

BRIEF DESCRIPTION OF THE DRAWINGS

For the sake of better comprehension, the invention will be explained in more detail below with reference to an example embodiment which does not restrict the scope of protection. In this context.

DETAILED DESCRIPTION OF THE EXAMPLE EMBODIMENTS

Figure 1:
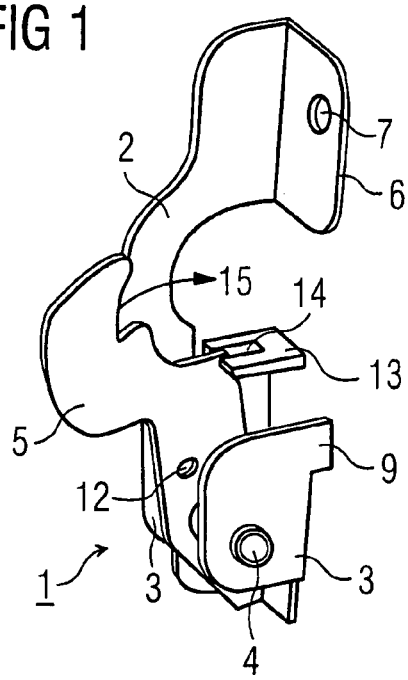
FIGS. 1 to 4 show the arresting device of an embodiment in four different views.
Figure 2:
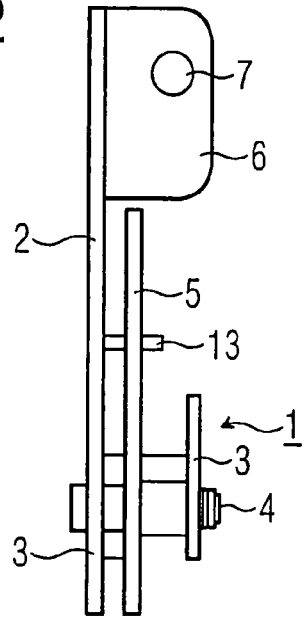
Figure 3:
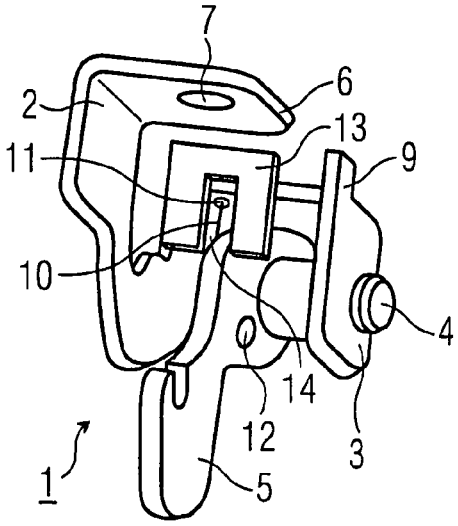
Figure 4:
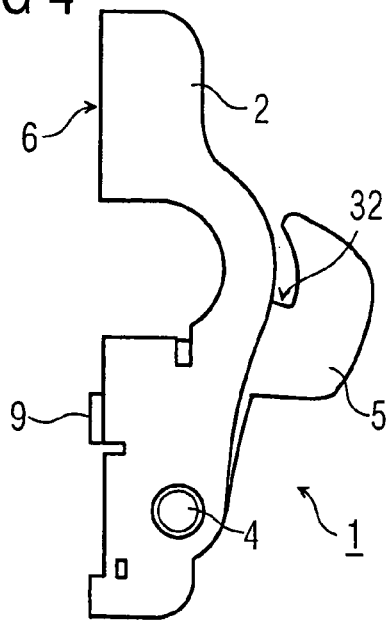

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

According to FIGS. 1 to 4 the arresting device 1 of an embodiment of the present application has a carrier 2 in the form of a sheet metal plate which is bent essentially into a U-shape, a pivot axis 4 which is held in side sections 3 of the sheet metal plate and is the form of an axially secured bolt, and a hook-like arresting element 5 which is pivotably arranged on the bolt. The hook-like arresting element 5 is embodied as a single-armed, pendulum-like lever. A section 6 of the base metal plate is provided with a through-bore 7 for attaching the carrier 2 to an electric switch 8 (cf. FIGS. 5 to 8). A projection 9 in the sheet metal plate which protrudes transversely from its base face serves additionally to lock and support the carrier 2 in the electric switch 8.

In order to hold the arresting element 5 in its position of rest, a restoring spring 10 is provided in the form of a rotational spring which is supported on the one hand on the carrier 2 and on the other hand on the arresting element 5. For this purpose, the ends of the restoring spring 10 engage behind corresponding through-bores 11 and 12 in the carrier 2 and in the arresting element 5. In a section 13 which is bent out of one of the side sections of the sheet metal plate a slit 14 is provided which extends in the pivoting direction 15 of the arresting element 5 in order to guide it.

According to FIGS. 5 to 8, the arresting device 1 of an embodiment of the present application serves to block the movement of a drive train 16 of the electric switch 8 into its ON position.

The electric switch 8 which is illustrated is a low-voltage power switch. In this context, only one of the drive trains 16 for a movable contact 18 of the switch is shown in FIGS. 5 to 8. The movable contact 18 which is shown in the form of a contact lever is arranged on a first contact carrier 20, which pivots about a second pivot bearing 21, so as to be pivotable about a first pivot bearing 19 together with further movable contacts (not illustrated) which are arranged parallel to the contact lever. Opposite the movable contacts 18 which are held by the first contact carrier 20 there is a common locationally fixed contact 22, together with which they form a first switching contact arrangement of the low-voltage power switch. Further switching contact arrangements (not shown) are arranged parallel to this first switching contact arrangement in the electric switch 8, with all the contact carriers 20 of these switching contact arrangements being coupled by way of separate coupling rods 23 to a common drive shaft 24 in the form of a switching shaft.

In this way, the drive shaft 24, the coupling rod 23 and the contact carrier 20 therefore form the drive train 16 for the moveable contact 18 which is shown and in which the coupling rod 23 is composed of a switching shaft extension arm 25 and a coupling element 26 which are fixedly arranged on the drive shaft 24, and in which the coupling rod 26 is connected to the contact carrier 20 by way of a first coupling bolt 27 and to the switching shaft extension arm 25 by way of a second coupling bolt 28.

In order to close the switching contact arrangement, the drive shaft 24 can be rotated in the clockwise direction into an ON position by way of a drive device (not illustrated), and can be latched in this ON position by way of a first latching device (likewise not illustrated), in which case when the drive shaft is in the ON position the other elements of the drive train 16 are also in their ON position. When this first latching device is released, the drive shaft 24 is rotated in the counterclockwise direction into its OFF position under the effect of the force of contact force springs 29 (cf. FIG. 5) and under the effect of electrodynamic forces which are caused by the currents flowing across the contacts 18 and 22.

Although the electric switch 8 has, in a known fashion, a further latching device (not shown), this further latching device serves to latch a switch-on spring whose force is necessary to move the drive train 16 into its ON position. However, this further latching device does not act as a device for blocking the drive train 16 itself since the switch on spring is decoupled from the drive train 16 until the spring is released.

Instead, the arresting device 1 of an embodiment of the present application, which is illustrated separately in FIGS. 1 to 4, serves to block the movement of the drive train 16 into its ON position. The new arresting device 1 is attached, on the left hand side wall of a supporting structure 30 of the electric switch 8, to a bent attachment limb 31 of this supporting structure 30 below the drive shaft 24.

Figure 5:
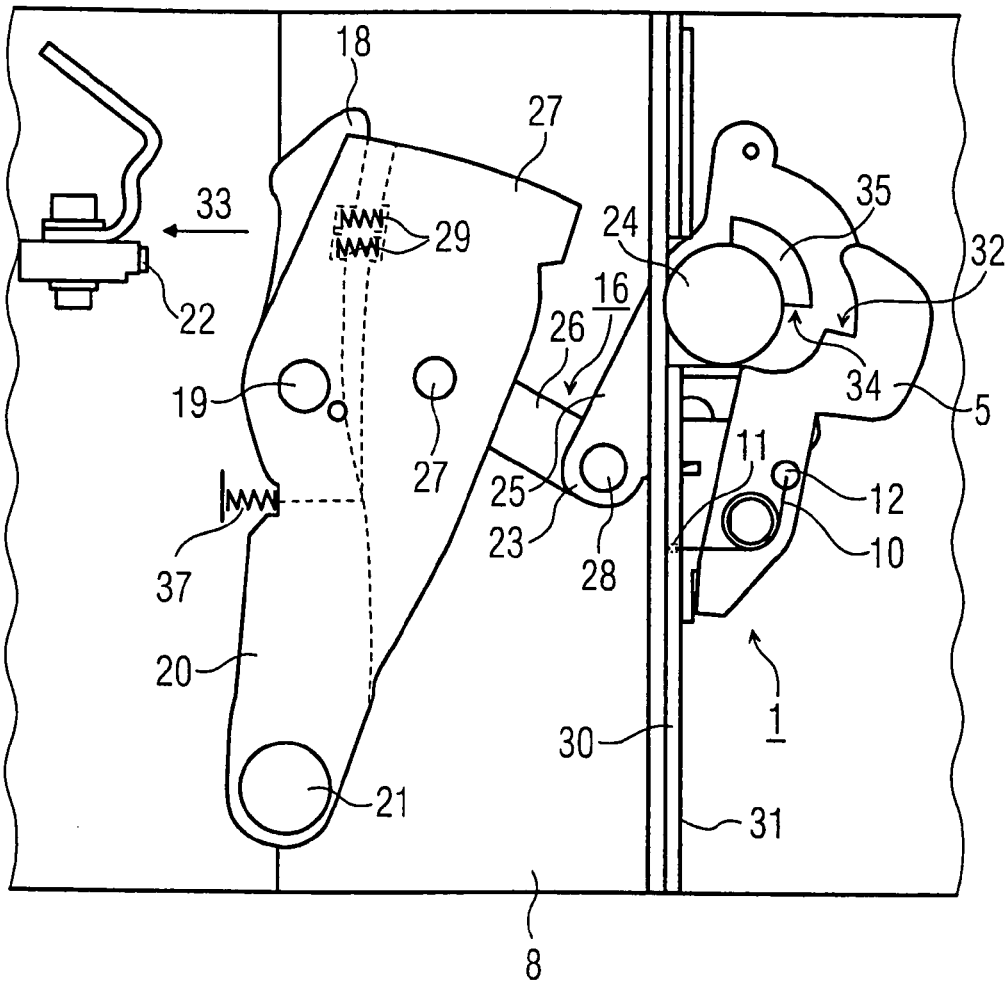
FIGS. 5 to 8 show a detail of an electric switch with a drive train and an embodiment of the inventive arresting device for blocking the movement of the drive train into its setting.

FIG. 5 shows the arresting element 5 in its position of rest in which it is not operatively connected to the drive train 16. The restoring spring 10 under whose force effect the arresting element 5 is subjected is dimensioned here in such a way that it holds the arresting element in its position of rest when the switch accelerates when subjected to 15g.

The arresting element 5 has a first working face 32 which, in the course of a movement (cf. FIGS. 6 to 8) which is caused by an acceleration of the low-voltage power switch above 15g which acts in the closing direction 33 of the drive train 16, comes into contact with an assigned second working face 34 of a cam-like drive shaft segment 35 and thus the drive shaft 24 to a standstill. Since the contact carrier 20 is connected directly to the drive shaft 24 via the coupling rod 23, the drive shaft 24 is brought to a standstill before the contacts 18 and 22 make contact.

Figure 6:
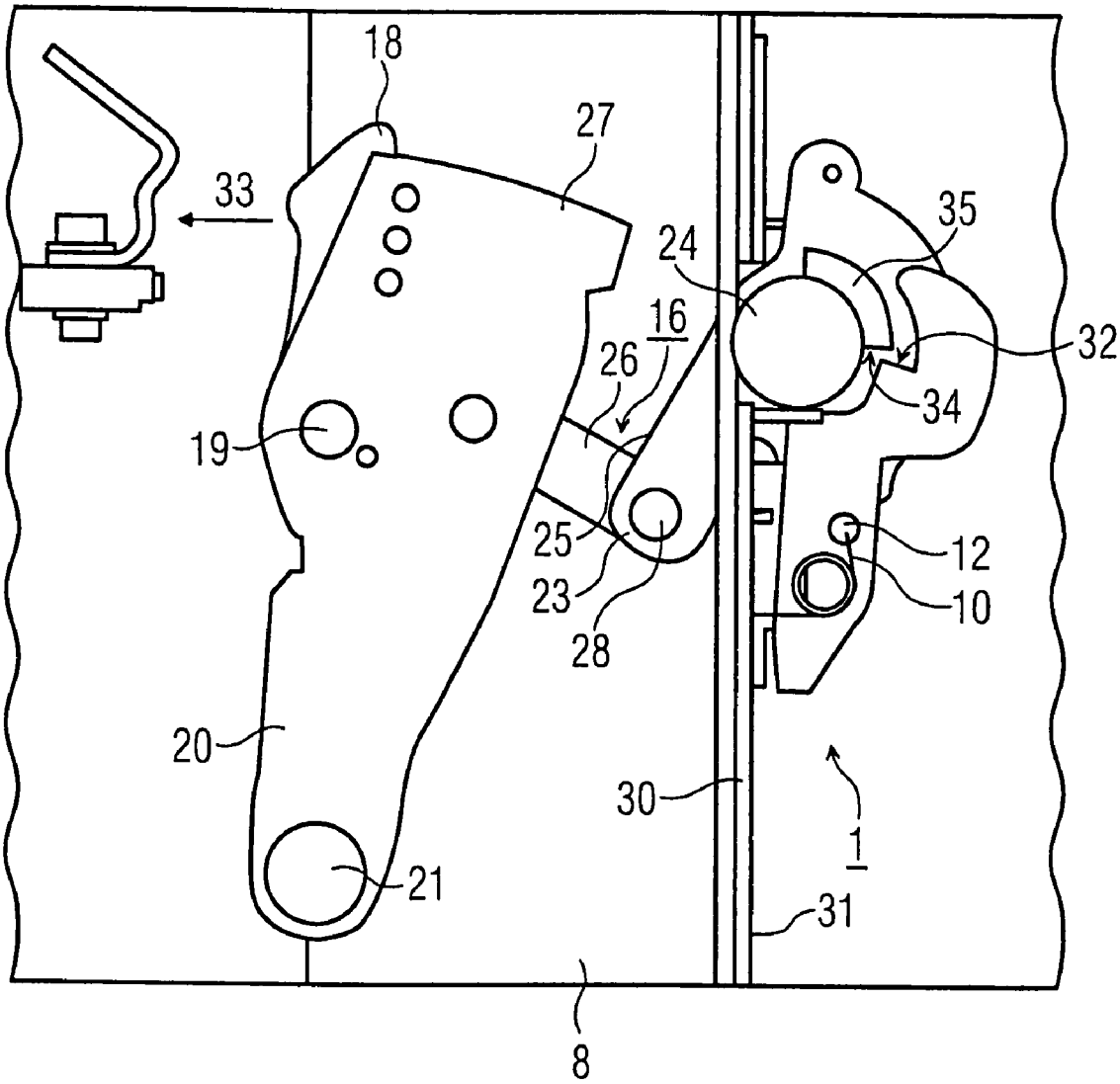

FIG. 6 shows the drive train 16 at the start of this movement. Both the movable contact 18 and the arresting element pivot in the closing direction 33, that is to say in the direction of the locationally fixed contact 22. In this context, the drive shaft 24 is also rotated. In the further course of the movement (cf. FIG. 7), the working face of the arresting element also moves under the working face 34 of the cam-like drive shaft segment 35 simultaneously with the rotation of the drive shaft 24.

Figure 7:
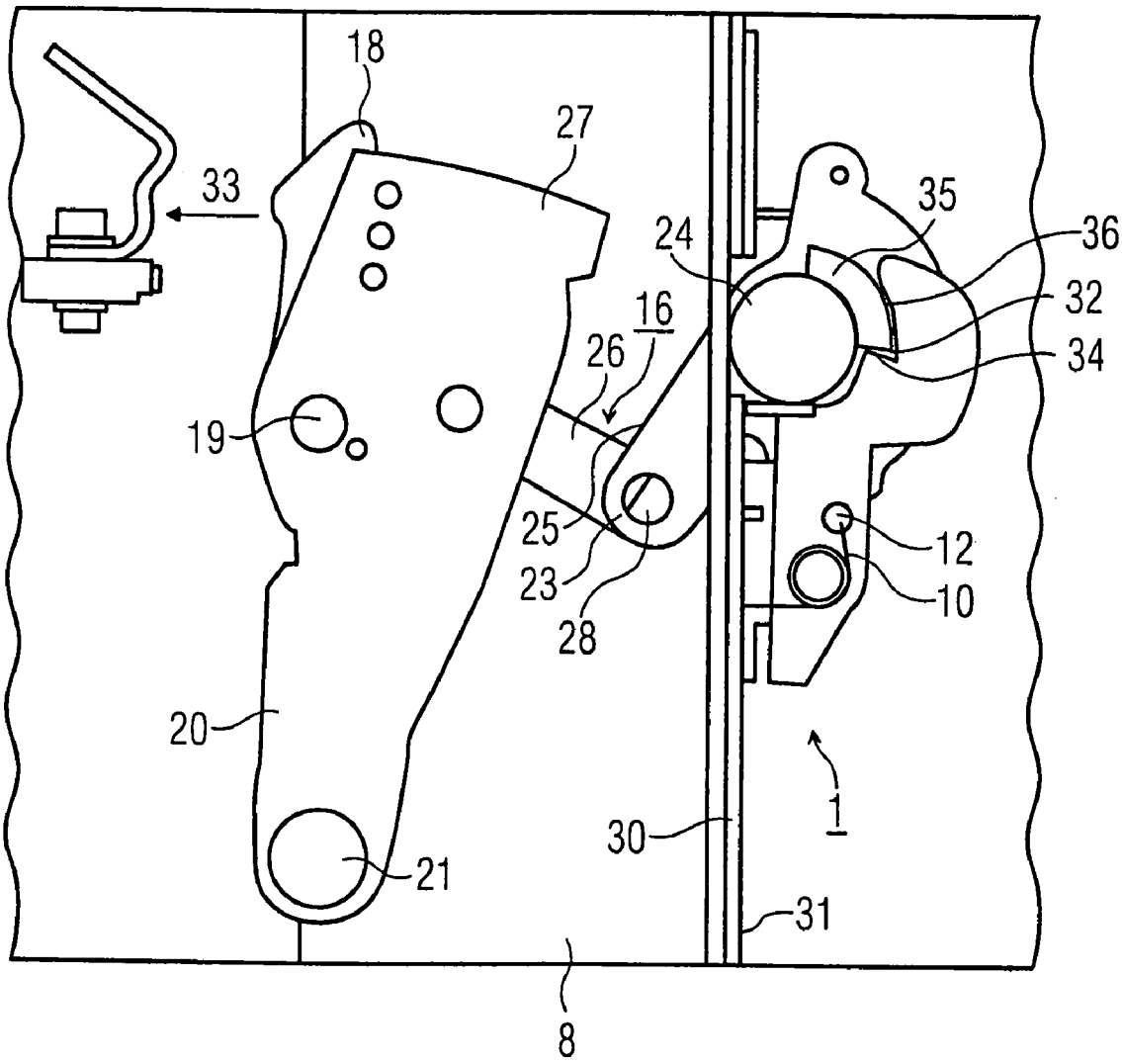

According to FIG. 7, a stop face 36 which acts as a stop is provided on the cam-like drive shaft segment 35, against which stop face 36 the arresting element 5 abuts when the working faces 32 and 34 are located essentially opposite one another over their entire length, separated by an acutely angled gap.

Figure 8:
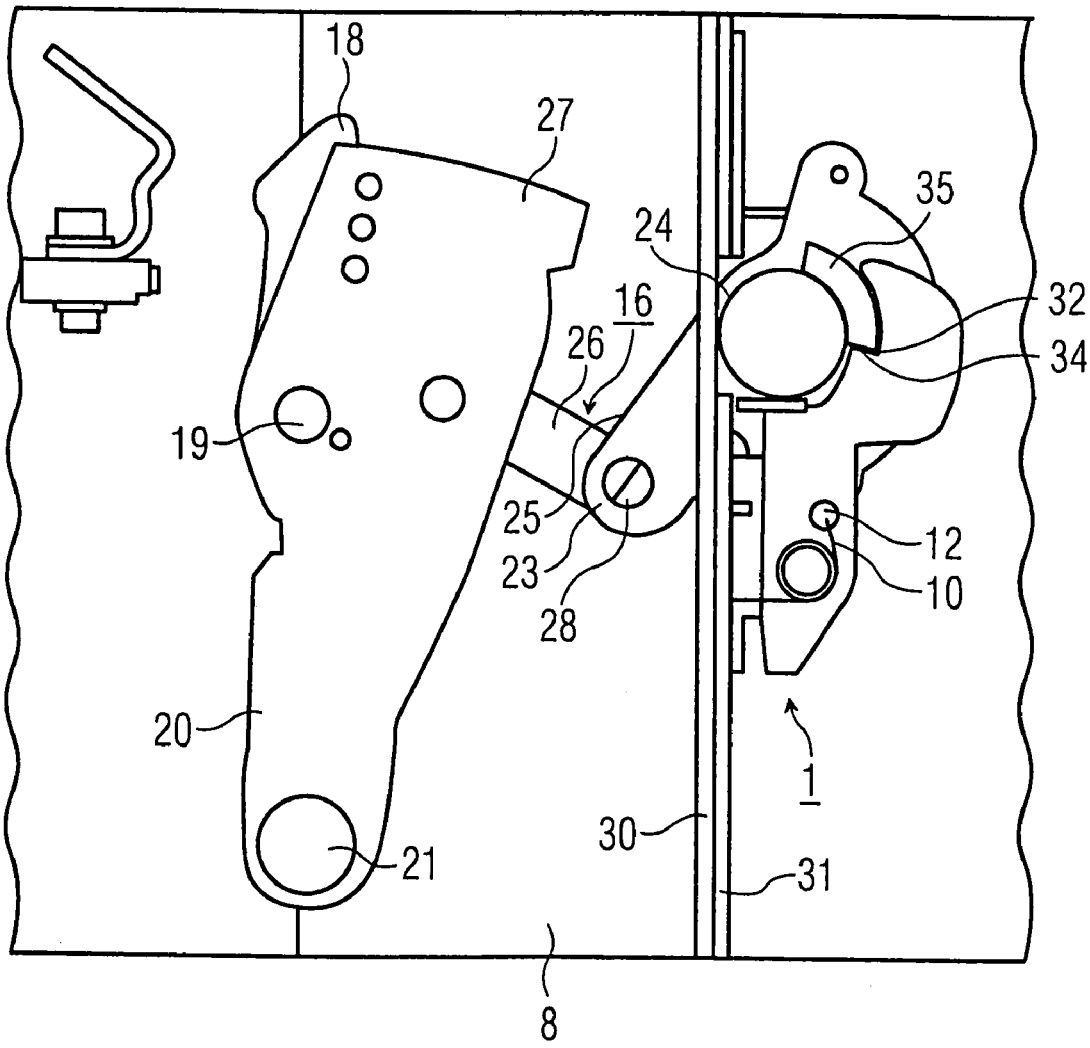

According to FIG. 8, the drive shaft 24 can still rotate a little further into the movement path of the working face 32 of the arresting element 5 after the arresting element 5 has abutted and before the two working faces 32 and 34 touch one another. As a result, on the one hand the arresting element 5 is blocked in its arresting position by the drive shaft segment 35. On the other hand, the arresting element 5 blocks the drive shaft 24 so that the latter cannot rotate further in the clockwise direction. As a result, the contact carrier 20, and thus the movable contacts 18, then also come to a standstill.

As soon as the external forces abate, the contact carrier 20 and thus the entire drive train 16 together with the drive shaft 24 move back into their OFF position under the effect of the force of a spring 37. As a result, the arresting element is itself released in order to pivot back into its position of rest. (cf. FIG. 5). It pivots back here under the effect of the force of the restoring spring 10.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An arresting device for a drive train which, to close a movable contact of an electric switch, is movable from an OFF position into an ON position, the arresting device comprising:

an arresting element, including a pivot axis extending outside its pivoting point, wherein, when the drive train is in its OFF position, the arresting element pivots from a position of rest into an arresting the position owing to a force which acts on its pivoting point, in the closing direction of the drive train, wherein, in its arresting position, the arresting element is operatively connected to the drive train and blocks the movement of the drive train into its ON position, and wherein, in its position of rest, the arresting element is under the force effect of a restoring spring and does not pivot into its arresting position until a defined acceleration of the electric switch is acting in the closing direction of the drive train.

2. The arresting device as claimed in claim 1, wherein the restoring spring is dimensioned such that the arresting element only pivots into its arresting position starting from 15 times the gravitational acceleration of the electric switch.

3. The arresting device as claimed in claim 2, wherein, in its arresting position, the arresting element is operatively connected to the working face which is formed in a locationally fixed fashion on a drive shaft of the drive train.

4. The arresting device as claimed in claim 3, wherein the working face is formed on a cam-like drive shaft segment.

5. The arresting device as claimed in claim 2, wherein a stop, against which the arresting element abuts briefly before it reaches its arresting position, is assigned to the arresting element.

6. The arresting device as claimed in claim 5, wherein the stop is formed by a stop face of the cam-like drive signal.

7. A drive train which, to close a moveable contact of an electric switch, is movable from an OFF position into an ON position, the drive train comprising:

a drive shaft;

a coupling train, to couple the drive shaft to the moveable contact; and an arresting device as claimed in claim 2 to block movement of the drive train into its ON position.

8. An electric switch, comprising:

a drive train as claimed in claim 7, which, to close a moveable contact of the electric switch, is movable out of an OFF position into an ON position.

9. An electric switch, comprising:

a drive train which, to close a moveable contact of the electric switch, is movable out of an OFF position into an ON position; and an arresting device, as claimed in claim 2, to block movement of the drive train into its ON position.

10. The arresting device as claimed in claim 1, wherein, in its arresting position, the arresting element is operatively connected to the working face which is formed in a locationally fixed fashion on a drive shaft of the drive train.

11. The arresting device as claimed in claim 10, wherein the working face is formed on a cam-like drive shaft segment.

12. A drive train which, to close a moveable contact of an electric switch, is movable from an OFF position into an ON position, the drive train comprising:

a drive shaft;

a coupling train, to couple the drive shaft to the moveable contact; and an arresting device as claimed in claim 10 to block movement of the drive train into its ON position.

13. An electric switch, comprising:

a drive train as claimed in claim 12, which, to close a moveable contact of the electric switch, is movable out of an OFF position into an ON position.

14. An electric switch, comprising:

a drive train which, to close a moveable contact of the electric switch, is movable out of an OFF position into an ON position; and an arresting device, as claimed in claim 10, to block movement of the drive train into its ON position.

15. The arresting device as claimed in claim 1, wherein a stop, against which the arresting element abuts briefly before it reaches its arresting position, is assigned to the arresting element.

16. The arresting device as claimed in claim 15, wherein the stop is formed by a stop face of the cam-like drive signal.

17. A drive train which, to close a moveable contact of an electric switch, is movable from an OFF position into an ON position, the drive train comprising:

a drive shaft;

a coupling train, to couple the drive shaft to the moveable contact; and an arresting device, as claimed in claim 1, to block movement of the drive train into its ON position.

18. An electric switch, comprising:

a drive train as claimed in claim 17, which, to close a moveable contact of the electric switch, is movable out of an OFF position into an ON position.

19. An electric switch, comprising:

a drive train which, to close a moveable contact of the electric switch, is movable out of an OFF position into an ON position; and an arresting device, as claimed in claim 1, to block movement of the drive train into its ON position.

* * * * *